US011223149B1

(12) United States Patent
He et al.

(10) Patent No.: US 11,223,149 B1
(45) Date of Patent: Jan. 11, 2022

(54) DUAL ELASTIC PLATE CONNECTOR

(71) Applicant: AMPHENOL EAST ASIA ELECTRONIC TECHNOLOGY (SHEN ZHEN) CO., LTD., Shen Zhen (CN)

(72) Inventors: Dan-Ren He, Shen Zhen (CN); De-Ming Li, Shen Zhen (CN)

(73) Assignee: AMPHENOL EAST ASIA ELECTRONIC TECHNOLOGY (SHEN ZHEN) CO., LTD., Shen Zhen (CN)

( * ) Notice: Subject to any disclaimer, the term of this patent is extended or adjusted under 35 U.S.C. 154(b) by 0 days.

(21) Appl. No.: 16/905,004

(22) Filed: Jun. 18, 2020

(51) Int. Cl.
*H01R 13/11* (2006.01)
*H01R 4/18* (2006.01)

(52) U.S. Cl.
CPC ..... *H01R 13/11* (2013.01); *H01R 4/18* (2013.01)

(58) Field of Classification Search
CPC ..... H01R 13/11
See application file for complete search history.

(56) References Cited

U.S. PATENT DOCUMENTS 7,938,695 B2 * 5/2011 Furutani ..... H01R 4/185 439/852
2008/0070452 A1 * 3/2008 Komiyama ..... H01R 13/113 439/852

* cited by examiner

*Primary Examiner* — Ross N Gushi
(74) *Attorney, Agent, or Firm* — Muncy, Geissler, Olds & Lowe, P.C.

(57) ABSTRACT

A dual elastic plate connector includes an engagement portion and a combination portion; the engagement portion including a first elastic plate, a second elastic plate, and a protrusion part; the combination portion combined with a cable; the first elastic plate including a head portion and a stem portion, with a curve structure as a connection portion connected therebetween; the second elastic plate including a head portion and a stem portion, with a curve structure as a connection portion connected therebetween; a bending direction of the two bending structures being arranged in opposite; the stem portion of the first elastic plate overlapping the head portion of the second elastic plate. When the connector is combined with another connector, the yield resistance, the combination stability, and the forward contact force are improved by the reverse stack arrangement between the two elastic plates.

3 Claims, 2 Drawing Sheets

DUAL ELASTIC PLATE CONNECTOR

BACKGROUND OF THE INVENTION

1. Field of the Invention

The present invention relates to connectors, and more particularly, to a dual elastic plate connector.

2. Description of the Related Art

Existing connector terminals apply a single elastic plate contact point and are stacked in the same direction. Such structure is insufficient in connection stability, yield resistance and forward contact force, and it is difficult for such structure to meet the user's demand for transient break performance testing.

SUMMARY OF THE INVENTION

The present invention aims at resolving current technical incapability, and therefore provides a dual elastic plate connector. With an optimized structure, the insufficiency of connection stability and forward contact force of the current single elastic plate connector is improved.

For achieving the aforementioned objectives, the present invention provides a dual elastic plate connector, comprising an engagement portion and a combination portion; the engagement portion being engaged with another connector; the engagement portion including a first elastic plate, a second elastic plate, and a protrusion part; the combination portion combined with a cable; the first elastic plate comprising a head portion and a stem portion, with a curve structure as a connection portion connected between the head portion and the stem portion; the second elastic plate comprising a head portion and a stem portion, with a curve structure as a connection portion connected between the head portion and the stem portion; a bending direction of the bending structure of the first elastic plate being arranged in opposite to a bending direction of the bending structure of the second elastic plate; the stem portion of the first elastic plate overlapping the head portion of the second elastic plate; the protrusion part being disposed on an inner wall of the engagement portion; when the connector is combined with another connector, a terminal of the other connector is inserted between the first elastic plate and the protrusion part and contacts the stem portion of the first elastic plate; when being pressed by the inserted terminal of the other connector, the first elastic plate is deformed and abuts against the head portion of the second elastic plate.

Preferably, in the dual elastic plate connector, the engagement portion further comprises a first curve member and a second curve member; an end of the first curve member is connected with a lateral side of the head portion of the first elastic member, and another end of the first curve member is connected with a first engagement end of the engagement portion; an end of the second curve member is connected with a lateral side of the stem portion of the second elastic member, and another end of the second curve member is connected with a second engagement end of the engagement portion.

Preferably, in the dual elastic plate connector, the engagement portion comprises a curve block plate disposed on an engagement end of the engagement portion; the combination portion comprises a plane tube, a square block plate, an expanding tube, a tapering block plate, and a wire press ring; the wire press ring disposed on a junction between the combination portion and the engagement portion and comprising a press plate and a block plate, the plane tube disposed between the wire press ring and the square block plate; the square block plate and the expanding tube disposed at a middle portion of the combination portion, the square block plate positioned between the plane tube and the expanding tube; the tapering block plate disposed on an end part of the combination portion.

With such configuration, compared with conventional art, the present invention improves the insufficiency of combination stability and forward contact force of current single elastic plate connector through an optimized structure. The inventive feature is that the present invention applies two elastic plates for improving the yield resistance of the elastic plates, and the two elastic plates are reversely stacked and supported for increasing the forward contact force. When the terminal of another connector is inserted, the head portion of the second elastic plate abuts against the stem portion of the first elastic plate, so as to improve the yield resistance and the forward contact force and increase the stability of the contact point of the terminals, thereby enhancing the overall performance of the connector.

DETAILED DESCRIPTION OF THE INVENTION

The aforementioned and further advantages and features of the present invention will be understood by reference to the description of the preferred embodiment in conjunction with the accompanying drawings where the components are illustrated based on a proportion for explanation but not subject to the actual component proportion.

Figure 1:
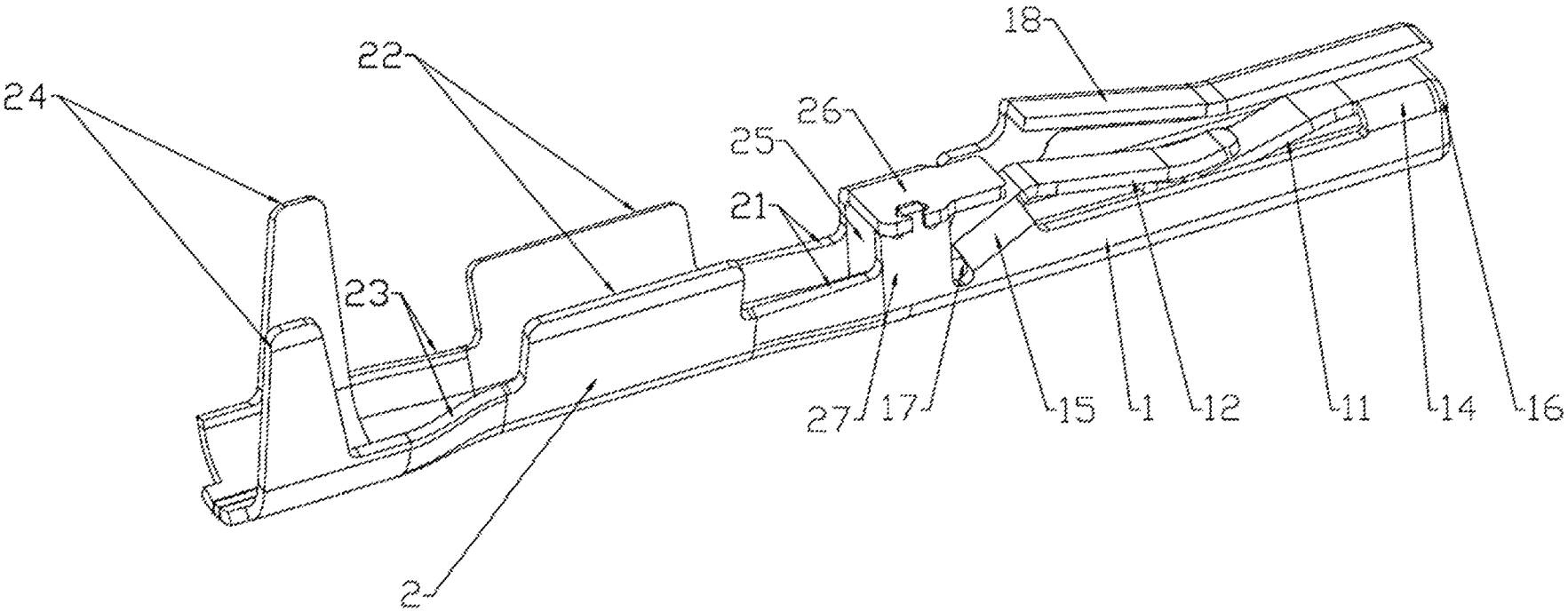
FIG. 1 is a perspective view of the dual elastic plate connector in accordance with an embodiment of the present invention.
Figure 2:
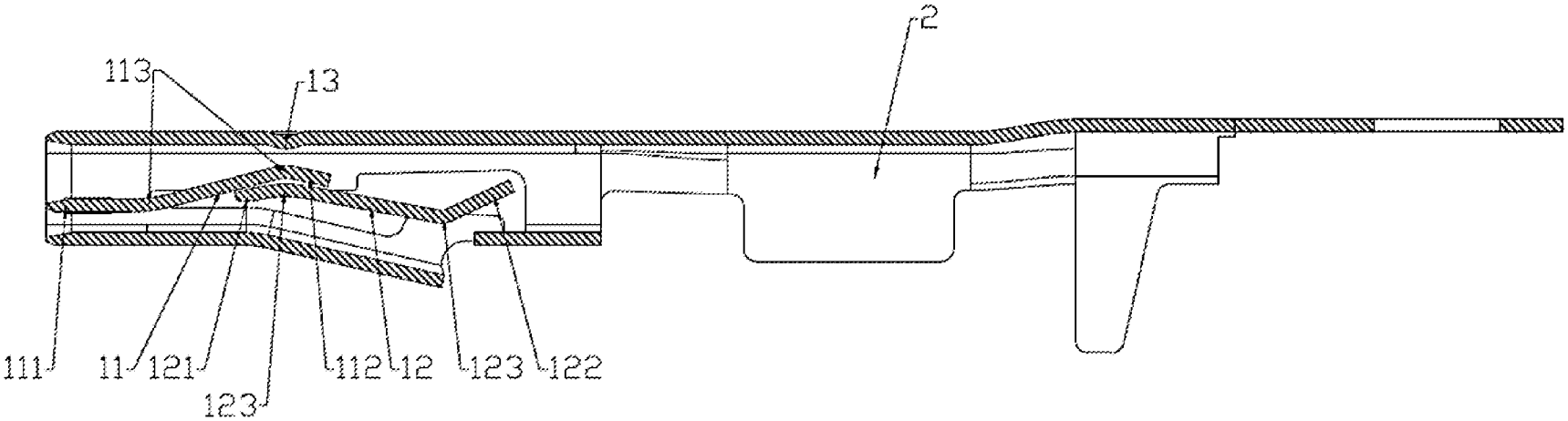
FIG. 2 is a sectional view of the dual elastic plate connector in accordance with an embodiment of the present invention.

By reference to FIG. 1 and FIG. 2, following detailed description provide illustration of embodiments of the present invention. However, the present invention is not limited by the description.

Embodiment 1

Referring to FIG. 1 and FIG. 2, a dual elastic plate connector comprises an engagement portion 1 and a combination portion 2.

The engagement portion 1 is engaged with another connector; the engagement portion includes a first elastic plate 11, a second elastic plate 12, and a protrusion part 13.

The combination portion 2 is combined with a cable

The first elastic plate 11 comprises a head portion 111 and a stem portion 112, with a curve structure 113 as a connection portion connected between the head portion 111 and the stem portion 112. The second elastic plate 12 comprises a head portion 121 and a stem portion 122, with a curve structure 123 as a connection portion connected between the head portion 121 and the stem portion 122. A bending direction of the bending structure 113 of the first elastic plate 11 is in opposite to a bending direction of the bending structure 123 of the second elastic plate 12. The stem portion 112 of the first elastic plate 11 overlaps the head portion 121 of the second elastic plate 12.

The protrusion part 13 is disposed on an inner wall of the engagement portion 1. When the connector is combined with another connector, a terminal of the other connector is inserted between the first elastic plate 11 and the protrusion part 13 and contacts the stem portion 112 of the first elastic plate 11. When being pressed by the inserted terminal of the other connector, the first elastic plate 11 is deformed and abuts against the head portion 121 of the second elastic plate 12.

Embodiment 2

Based on the embodiment 1, referring to FIG. 1 and FIG. 2, the engagement portion 1 of the dual elastic plate connector further comprises a first curve member 14 and a second curve member 15.

An end of the first curve member 14 is connected with a lateral side of the head portion 111 of the first elastic member 11, and another end of the first curve member 14 is connected with a first engagement end 16 of the engagement portion 1. An end of the second curve member 15 is connected with a lateral side of the stem portion 122 of the second elastic member 12, and another end of the second curve member 15 is connected with a second engagement end 17 of the engagement portion 1.

Embodiment 3

Based on the embodiments above, referring to FIG. 1 and FIG. 2, the engagement portion 1 comprises a curve block plate 18 disposed on an engagement end of the engagement portion 1.

The combination portion 2 comprises a plane tube 21, a square block plate 22, an expanding tube 23, a tapering block plate 24, and a wire press ring 25.

The wire press ring 25 is disposed on a junction between the combination portion 2 and the engagement portion 1 and comprises a press plate 26 and a block plate 27; the plane tube 21 is disposed between the wire press ring 25 and the square block plate 27. The square block plate 22 and the expanding tube 23 disposed at a middle portion of the combination portion 2; the square block plate 22 is positioned between the plane tube 21 and the expanding tube 23. The tapering block plate 24 is disposed on an end part of the combination portion 2.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A dual elastic plate connector, comprising:

an engagement portion and a combination portion;

the engagement portion being engaged with another connector; the engagement portion including a first elastic plate, a second elastic plate, and a protrusion part;

the combination portion being combined with a cable;

the first elastic plate comprising a head portion and a stem portion, with a curve structure as a connection portion connected between the head portion and the stem portion;

the second elastic plate comprising a head portion and a stem portion, with a curve structure as a connection portion connected between the head portion and the stem portion;

a bending direction of the curve structure of the first elastic plate being arranged in opposite to a bending direction of the curve structure of the second elastic plate;

the stem portion of the first elastic plate overlapping the head portion of the second elastic plate;

the protrusion part being disposed on an inner wall of the engagement portion;

when the connector is combined with another connector, a terminal of the other connector is inserted between the first elastic plate and the protrusion part and contacts the stem portion of the first elastic plate; and when being pressed by the inserted terminal of the other connector, the first elastic plate is deformed and abuts against the head portion of the second elastic plate, wherein the engagement portion comprises a curve block plate integratedly disposed on an engagement end of the engagement portion and opposite to the protrusion part, wherein a bending direction of the curve block plate is corresponding to the connection portion of the second elastic plate.

2. The dual elastic plate connector of claim 1, wherein the engagement portion further comprises a first curve member and a second curve member;

an end of the first curve member is connected with a lateral side of the head portion of the first elastic plate, and another end of the first curve member is connected with a first engagement end of the engagement portion;

an end of the second curve member is connected with a lateral side of the stem portion of the second elastic plate, and another end of the second curve member is connected with a second engagement end of the engagement portion.

3. The dual elastic plate connector of claim 1, wherein the combination portion comprises a plane tube, a square block plate, an expanding tube, a tapering block plate, and a wire press ring;

the wire press ring disposed on a junction between the combination portion and the engagement portion and comprising a press plate and a block plate;

the plane tube disposed between the wire press ring and the square block plate;

the square block plate and the expanding tube disposed at a middle portion of the combination portion, the square block plate positioned between the plane tube and the expanding tube;

the tapering block plate disposed on an end part of the combination portion.

* * * * *